US005792602A

United States Patent [19]

Maskasky et al.

[11] Patent Number: 5,792,602

[45] Date of Patent: Aug. 11, 1998

[54] PROCESS FOR THE PREPARATION OF SILVER HALIDE EMULSIONS HAVING IODIDE CONTAINING GRAINS

[75] Inventors: Joe E. Maskasky; Victor P. Scaccia, both of Rochester, N.Y.; Samuel Chen, Penfield, N.Y.

[73] Assignee: Eastman Kodak Company, Rochester, N.Y.

[21] Appl. No.: 819,231

[22] Filed: Mar. 17, 1997

[51] Int. Cl.[6] ..... G03C 1/015

[52] U.S. Cl. ..... 430/569; 430/639

[58] Field of Search ..... 430/569, 639

[56] References Cited

U.S. PATENT DOCUMENTS

| | | | |
|---|---|---|---|
| 5,358,842 | 10/1994 | Kasai et al. | 430/569 |
| 5,389,508 | 2/1995 | Takada et al. | 430/569 |
| 5,418,124 | 5/1995 | Suga et al. | 430/567 |
| 5,476,760 | 12/1995 | Fenton et al. | 430/567 |
| 5,525,460 | 6/1996 | Maruyama et al. | 430/567 |
| 5,527,664 | 6/1996 | Kikuchi et al. | 430/569 |
| 5,607,828 | 3/1997 | Maskasky | 430/567 |
| 5,667,955 | 9/1997 | Maskasky | 430/567 |

*Primary Examiner*—Mark F. Huff

*Attorney, Agent, or Firm*—Carl O. Thomas

[57] ABSTRACT

A process is disclosed of preparing a photographically useful emulsion containing radiation-sensitive silver iodohalide grains. Silver halide grains having a face centered cubic rock salt crystal lattice structure are precipitated within an aqueous dispersing medium including a hydrophilic colloid peptizer. Iodide ion is introduced into the crystal lattice structure by introducing elemental iodine into the dispersing medium and maintaining the dispersing medium within a pH range of from 5 to 8.

8 Claims, No Drawings

PROCESS FOR THE PREPARATION OF SILVER HALIDE EMULSIONS HAVING IODIDE CONTAINING GRAINS

FIELD OF THE INVENTION

The invention relates to a process of preparing iodide containing radiation-sensitive silver halide emulsions useful in photography.

DEFINITION OF TERMS

In referring to grains and emulsions containing two or more halides, the halides are named in order of ascending concentrations.

The term "silver iodohalide" in referring to grains or emulsions indicates a grain structure in which silver chloride and/or bromide provide a face centered cubic rock salt crystal lattice structure containing iodide ions.

The term "high bromide" in referring to grains and emulsions indicates that bromide is present in a concentration of greater than 50 mole percent, based on total silver.

The term "low surface iodide" in referring to grains indicates that iodide is present in a concentration of less than 2 mole percent, based on silver within 0.02 μm of the surface of the grains.

The term "halide converted" is employed in the art recognized sense to designate a silver halide grain structure in which halide ion that forms a less soluble silver halide has displaced from the crystal lattice structure of the grain halide ion that forms a more soluble silver halide.

The term "equivalent circular diameter" or "ECD" is employed to indicate the diameter of a circle having the same projected area as a silver halide grain.

The term "coefficient of variation" or "COV" is defined as 100 times the standard deviation of grain ECD divided by average grain ECD.

The term "monodisperse" in referring to the grain population of a silver halide emulsion indicates a COV of less than 30 percent.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch (which consists essentially of amylopectin) or high amylose corn starch.

The term "oxidized" in referring to starch indicates a starch in which, on average, at least one α-D-glucopyranose repeating unit per starch molecule has been ring opened by cleavage of the 2 to 3 ring position carbon-to-carbon bond.

The term "cationic" in referring to starch indicates that the starch molecule has a net positive charge at the pH of intended use.

The term "water dispersible" in referring to starches indicates that, after boiling the starch in water for 30 minutes, the water contains, dispersed to at least a colloidal level, at least 1.0 percent by weight of the total starch.

*Research Disclosure* is published by Kenneth Mason Publications, Ltd., Dudley House, 12 North St., Emswolth, Hampshire P010 7DQ, England.

BACKGROUND

In the most widely employed form of photography, images are captured by a photographic element comprised of a support and at least one emulsion layer comprised of radiation-sensitive silver halide grains. The radiation-sensitive grains are prepared by reacting halide ions with silver ions in a dispersing medium. Silver chloride, silver bromide and silver iodide are known to be useful alone or in combination to form the radiation-sensitive grains.

Silver iodide grains exhibit β or γ phase crystal lattice structures that can accommodate only minor amounts of silver bromide and/or chloride. Difficulties with development have severely limited the use of these grains for latent image capture in photography.

Silver chloride and silver bromide each form a face centered cubic rock salt crystal lattice structure. All relative proportions of chloride and bromide ions can be accommodated in this crystal lattice structure. Iodide ion can be accommodated up to its saturation limit, which is approximately 40 mole percent, based on total silver, in a silver bromide crystal lattice structure and up to about 13 mole percent, based on silver in a silver chloride crystal lattice structure, the exact limit varying within a few percent, based on temperature.

A large proportion of photographic emulsions contain silver iodohalide grains—that is, grains in which a significant, performance modifying concentration of iodide is contained in a face centered cubic rock salt crystal lattice structure formed by one or both of the silver chloride and bromide. The highest levels of photographic sensitivity are typically realized by providing high bromide grains containing a minor amount of iodide, such as silver iodobromide grains. The presence of minor amounts of iodide ion can also enhance the sensitivity of high chloride grains.

To appreciate the techniques and difficulties for preparing mixed halide grains that contain iodide, it is necessary to appreciate the relative solubilities of the different photographically useful silver halides.

Although the majority of the silver amd halide ions are confined to the grains, at equilibrium a small fraction of the silver and halide ions are also present in the dispersing medium, as illustrated by the following relationship:

$$Ag^+ + X^- \leftrightarrows AgX \quad (I)$$

where X represents halide. From relationship (I) it is apparent that most of the silver and halide ions at equilibrium are in an insoluble form while the concentration of soluble silver ions ($Ag^+$) and halide ions ($X^-$) is limited. However, it is important to note that equilibrium is a dynamic relationship—that is, a specific halide ion is not fixed in either the right hand or left hand position in relationship (I). Rather a constant interchange of halide ion between the left and right hand positions is occurring.

At any given temperature the activity product of $Ag^+$and $X^-$is at equilibrium a constant and satisfies the relationship:

$$Ksp=[Ag^+][X^-] \quad (II)$$

where Ksp is the solubility product constant of the silver halide. To avoid working with small fractions the following relationship is also widely employed:

$$-\log Ksp=pAg+pX \quad (III)$$

where pAg represents the negative logarithm of the equilibrium silver ion activity and pX represents the negative logarithm of the equilibrium halide ion activity. From relationship (III) it is apparent that the larger the value of the –log Ksp for a given halide, the lower is its solubility. The relative solubilities of the photographic halides (Cl, Br and I) can be appreciated by reference to Table I:

TABLE I

| Temp. °C. | AgCl -log Ksp | AgBr -log Ksp | AgI -log Ksp |
|---|---|---|---|
| 40 | 9.2 | 11.6 | 15.2 |
| 50 | 8.9 | 11.2 | 14.6 |
| 60 | 8.6 | 10.8 | 14.1 |
| 80 | 8.1 | 10.1 | 13.2 |

From Table I it is apparent that at 40° C. the solubility of AgCl is one million times higher than that of AgI, while the solubility of AgBr ranges from about one thousand to ten thousand times that of AgI.

When silver ion and two or more halide ions are concurrently introduced into a dispersing medium, the silver ion precipitates disproportionately with the halide ion that forms the least soluble silver halide. It is therefore appreciated that the presence of local iodide ion concentration variances in the dispersing medium in the course of precipitation of silver iodohalide grains result in iodide ion non-uniformities in the grains precipitated. When the limited ability of a face centered cubic rock salt crystal lattice structure to accommodate iodide ions is taken into account, it is readily appreciated that if iodide ion non-uniformities in the dispersing medium are sufficiently large, a separate, unwanted high iodide (β or γ phase) grain population can be produced.

As a technique for better controlling the uniformity of iodide ion availability within the dispersing medium it has been recently suggested (see Takada et al U.S. Pat. No. 5,389,508, Suga et al U.S. Pat. No. 5,418,124, Maruyama et al U.S. Pat. No. 5,525,460 and Kikuchi et al U.S. Pat. No. 5,527,664) that the uniformity of iodide ion within the dispersing medium can be better controlled by introducing iodide in the form of a compound satisfying the formula:

R-I (IV)

wherein R represents a monovalent organic residue which releases iodide on upon reacting with a nucleophilic reagent, such as hydroxyl or sulfite ion.

It is known that the properties of silver halide grains can be modified by halide conversion. This is accomplished by introducing into a silver halide emulsion halide ions that have a lower solubility than halide ions contained in the grains while withholding the introduction of silver ions. For example, silver chloride grains can be transformed into converted halide grains by the introduction of bromide and/or iodide ions. Similarly, silver bromide grains can be transformed into converted halide grains by the introduction of iodide ions.

As a less soluble halide ion replaces a more soluble halide ion in the crystal lattice of the silver halide grain, a disruption of the crystal lattice occurs, since the reduction in silver halide solubility in progressing from chloride to bromide to iodide ions is also accompanied by an increase in the physical size of the ions. Halide conversion is known to create crystal lattice dislocations.

An early use of converted halide emulsions was to create silver halide grains that would, by reason of the internal crystal lattice disruptions, form latent image sites predominantly within the interior of the grains. Thus their use was primarily as direct positive emulsions, but they have also been used to advantage as negative working emulsions.

When interest developed in tabular grain emulsions in the early 1980's, halide conversions of tabular grains of the type previously practiced on conventional nontabular grains were observed to degrade or destroy the tabular character of the grains. Limited halide conversions of tabular grains were recognized to be possible, but in practice even limited halide conversions of tabular grain emulsions were avoided.

Recently Fenton et al U.S. Pat. No. 5,476,760 demonstrated that low surface iodide high bromide host tabular grain emulsions that undergo a limited halide conversion with potassium iodide followed by subsequent silver halide deposition are capable of producing higher photographic speeds than when the double-jet addition of silver and iodide ions replaces the halide conversion step. This has provided the art with its first positive incentive to incorporate a halide conversion step into the preparation of high bromide tabular grain emulsions.

In attempting to practice partial halide conversions on low surface iodide high bromide tabular grains it has been observed that a significant portion of the tabular grains are damaged in the halide conversion step. Specifically, after halide conversion significant concentrations of small grains are observed that have iodide concentrations matching the peak iodide concentrations introduced into the surviving tabular grains by halide conversion. It is believed that these small grains are fragments of tabular grains that "exploded" during the halide conversion step. That is, excessive stresses placed on the crystal lattice structure, believed to be attributable to excessive local iodide concentrations, have resulted in the tabular grain disintegrating. These fragments of tabular grains are hereinafter referred to as exploded grains or EG's.

In addition to the exploded grains a significant population of tabular grains have been observed that are only partially intact. These partially intact grains often appear to have had a bite taken out of the grain at an edge or a corner. From microscopic examination it has been concluded that these grains have impinged on a local area with an excessively high iodide ion concentration during the halide conversion step. If the tabular grain had been somewhat more centrally located in the local high iodide ion concentration region responsible for grain degradation, the grain would have exploded. These tabular grains are hereafter referred to as partially intact grains or PIG's.

The incidence of exploded grains and partially intact grains correlates inversely with the efficiency of the halide conversion process in producing partially halide converted low surface iodide high bromide tabular grains capable of providing increased photographic speed. Thus, the inclusion of exploded grains and partially intact grains in partially halide converted high bromide tabular grain emulsions works against achieving the highest attainable levels of photographic performance.

RELATED PATENT APPLICATION

Jagannathan et al U.S. Ser. No. 0/753,073, filed Nov. 20, 1996, titled A PROCESS FOR THE PREPARATION OF SILVER HALIDE EMULSIONS HAVING IODIDE CONTAINING GRAINS, commonly assigned, discloses a process for introducing iodide ion into the crystal lattice of silver halide grains by reacting an iodate ($IO_3^-$) anion with a sulfite anion, a known silver halide grain ripening agent.

PROBLEM TO BE SOLVED

The organic ligand release (see formula IV above) approach for introducing iodide into silver halide grain crystal lattice structures as well as the Jagannathan et al approach of employing iodate ($IO_3^-$) anion have significant disadvantages. In order to release iodide ion by these methods either a strong grain ripening agent, such as sulfite ion, or an elevated pH is required. Elevated pH conditions risk undesirably elevating fog levels in the emulsions. This occurs because the conditions are favorable for a portion of the silver ions, $Ag^+$, being reduced to $Ag^o$. When a few $Ag^o$ atoms are located in close proximity, the grain can spontaneously develop, independent of its exposure. This is sometimes referred to as reduction fog or R-typing.

The requirement of a sulfite anion is particularly undesirable, since sulfite is known to act as a grain ripening agent. That is, it tends to speed the ripening out of smaller grains onto larger grains and the preferential solubilization of grain edge and comer structures. This can have in undesirable effect of changing the shape of the grains. For example, where it is desired to maximize a particular class of external crystal faces, such as {111} or {100} faces, ripening can have the effect of rounding edges and corners to decrease the proportion of clearly {111} or {100} grain faces. This same edge and comer rounding can also degrade grain shapes, such as well-defined cubic, octahedral or tabular grains, causing regression toward spherical forms as a function of the degree of ripening that has occurred.

Finally, the use of iodate ($IO_3^-$) ion to release iodide ($I^-$) anion, as taught by Jagannathan et al, is relatively inefficient, since three sulfite anions are required to release a single iodide ($I^-$) anion, as illustrated by the following equation:

$$IO_3^- + 3SO_3^= \rightarrow I^- + 3SO_4^= \quad (V)$$

Thus, to arrive at a 3 mole percent iodide concentration in the grains by the process of Jagannathan et al, it is necessary to introduce nearly 10 mole percent sulfite ion, based on silver. This is a high proportion of sulfite ion.

SUMMARY OF THE INVENTION

In one aspect this invention is directed to a process of preparing a photographically useful emulsion, containing a dispersing medium and radiation-sensitive silver iodohalide grains, comprised of the following steps:

(1) providing an aqueous dispersing medium including a hydrophilic colloid peptizer, (2) precipitating silver halide grains having a face centered cubic rock salt crystal lattice structure, (3) introducing $I_2$ into the dispersing medium, and (4) maintaining the dispersing medium within a pH range of from 5 to 8 to release $I^-$ for incorporation into the crystal lattice structure.

Iodine ($I_2$) as a source of iodide ion ($I^-$) shares with formula IV R-I compounds and iodate ($IO_3^-$) the advantage of avoiding excessive local iodide ion concentrations at the point of addition into the dispersing medium within the reaction vessel.

A fundamental advantage of introducing iodine ($I_2$) rather than a formula IV R-I compound, as noted above, is that introduction of the R—moiety is eliminated along with its reaction by-product. Therefore, the potential for by-product unwanted interactions with other ingredients in the dispersing medium present during precipitation and added after precipitation is either eliminated or minimized.

A further advantage is that no strong reducing agent or ripening agent is required to release $I^-$ for incorporation into the grains. A mild reducing agent that is incapable of producing reduction fog can be employed. Further, as demonstrated in the Examples, the hydrophilic coilloids used as peptizers can enter into a redox reaction with iodine to release $I^-$, thereby entirely eliminating the need to introduce any material solely for the purpose of reacting with iodine.

Finally, in the practice of the present invention iodide ion is generated under mild conditions that eliminate any requirement for ripening agents to be present. This eliminates distortions in mean grain size, size-frequency profiles, and grain shape that are known to flow from the presence of ripening agents.

Thus, the use of iodine ($I_2$) as a source of iodide ion ($I^-$) makes more efficient use of materials, starting with a readily available material and eliminating iodide compound components that serve only to form reaction by-products. To this significant advantage is added the further advantage that iodine ($I_2$) provides a source of iodide ion ($I^-$) under mild conditions that avoid both the risks of reduction fog and grain ripening, with their known attendant disadvantages to grain characteristics and performance.

DESCRIPTION OF PREFERRED EMBODIMENTS

This invention is generally applicable to any conventional process for preparing a photographically useful emulsion comprised of a dispersing medium and radiation-sensitive silver iodohalide grains comprised of the following steps:

(1) providing an aqueous dispersing medium including a hydrophilic colloid peptizer for the silver iodohalide grains, (2) precipitating in the dispersing medium silver halide grains having a face centered cubic rock salt crystal lattice structure.

During or subsequent to step (2) iodide ions are introduced into the crystal lattice structure by reaction of iodine ($I_2$) with a mild reducing agent—that is, a reducing agent that is incapable of reducing (fogging) the grains (i.e., incapable of reducing $Ag^+$ to $Ag^o$ under the conditions of precipitation). Further, the reaction of iodine with the mild reducing agent is undertaken at a pH (preferably from 5 to 8) that is sufficiently low to eliminate or minimize reduction fog. Preferably the pH is kept on the acid side of neutrality—that is, at a pH of <7.0.

In a widely employed approach for preparing photographic emulsions containing radiation-sensitive silver iodohalide grains compatible with the processes of the invention an aqueous dispersing medium containing a hydrophilic colloid peptizer is placed into a reaction vessel. The peptizer is typically a gelatino-peptizer—i.e., gelatin or a gelatin derivative, such as acetylated or phthalated gelatin, but a variety of hydrophilic colloids are known to be useful as peptizers, as illustrated by *Research Disclosure*, Vol. 389, September 1996, Item 38957, II. Vehicles, vehicle extenders, vehicle-like addenda and vehicle related addenda, A. Gelatin and hydrophilic colloid peptizers.

It is specifically contemplated to employ as a hydrophilic colloid peptizer a water soluble cationic starch, as taught by Maskasky U.S. Pat. No. 5,604,085, or a water soluble oxidized cationic starch, as taught by Maskasky U.S. Pat. No. 5,607,828, the disclosures of which are here incorporated by reference. The use of these peptizers to prepare silver halide emulsions of varied silver halide grain structures is further disclosed by Maskasky et al U.S. Pat. Nos. 5,620,840, 5,667,955 and 5,693,459 as well as Maskasky et al U.S. Ser. No. 08/662,300, filed Jul. 29, 1996, titled PHOTOGRAPHIC EMULSIONS IMPROVED BY PEPTIZER SELECTION, commonly assigned and now allowed.

Generally useful in the preparation of silver halide emulsions according to the invention, but particularly preferred in the preparation of tabular grain emulsions, it is specifically contemplated to employ a water dispersible cationic starch as a hydrophilic colloid peptizer. The water dispersible cationic starch capable of acting as a peptizer can be obtained merely by modifying a conventional starch. Starches are generally comprised of two structurally distinctive polysaccharides, (α-amylose and amylopectin. Both are comprised of α-D-glucopyranose units. In (α-amylose the α-D-glucopyranose units form a 1,4-straight chain polymer. The repeating units take the following form:

(VI)

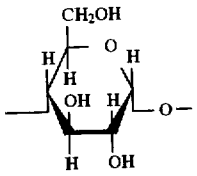

In amylopectin, in addition to the 1,4-bonding of repeating units, 6-position chain branching (at the site of the —$CH_2OH$ group above) is also in evidence, resulting in a branched chain polymer. It has been observed quite unexpectedly that superior tabular grain properties (e.g., higher average ECD's and aspect ratios) are realized when waxy corn starch, which consists essentially of amylopectin, is modified to a cationic form and employed for emulsion precipitation. The repeating units of starch and cellulose are diasteroisomers that impart different overall geometries to the molecules. The α anomer, found in starch and shown in formula VI above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterifica-tion or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;

Meisel U.S. Pat. No. 3,017,294;

Elizer et al U.S. Pat. No. 3,051,700;

Aszolos U.S. Pat. No. 3,077,469;

Elizer et al U.S. Pat. No. 3,136,646;

*Barber et al U.S. Pat. No. 3,219,518;

*Mazzarella et al U.S. Pat. No. 3,320,080;

Black et al U.S. Pat. No. 3,320,118;

Caesar U.S. Pat. No. 3,243,426;

Kirby U.S. Pat. No. 3,336,292;

Jarowenko U.S. Pat. No. 3,354,034;

Caesar U.S. Pat. No. 3,422,087;

*Dishburger et al U.S. Pat. No. 3,467,608;

*Beaninga et al U.S. Pat. No. 3,467,647;

Brown et al U.S. Pat. No. 3,671,310;

Cescato U.S. Pat. No. 3,706,584;

Jarowenko et al U.S. Pat. No. 3,737,370;

*Jarowenko U.S. Pat. No. 3,770,472;

Moser et al U.S. Pat. No. 3,842,005;

Tessler U.S. Pat. No. 4,060,683;

Raankin et al U.S. Pat. No. 4,127,563;

Huchette et al U.S. Pat. No. 4,613,407;

Blixt et al U.S. Pat. No. 4,964,915;

*Tsai et al U.S. Pat. No. 5,227,481; and

*Tsai et al U.S. Pat. No. 5,349,089.

In a preferred form the of the invention the starch is oxidized. The starch can be oxidized either before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

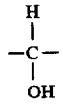

groups are commonly referred to as the glycol groups. The carbon-to-carbon bond between the glycol groups is replaced in the following manner:

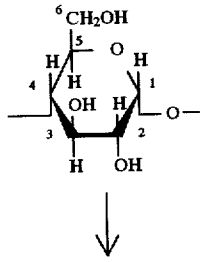

-continued

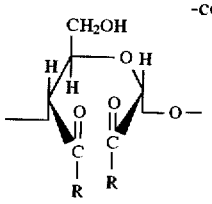

where R represents the atoms completing an aldehyde group or a carboxyl group.

The hypochlorite oxidation of starch is most extensively employed in commercial use. The hypochlorite is used in small quantities (<0.1% by weight chlorine, based on total starch) to modify impurities in starch, most notably to bleach colored impurities. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic or alkaline pH (e.g., >5 to 11). The oxidation reaction is exothermic, requiring cooling of the reaction mixture. Temperatures of less than 45° C. are preferably maintained. Using a hypobrormite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the precipitation of silver halide emulsions.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A*, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochloiite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidised Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidised Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 22). However, it is generally preferred to avoid driving oxidation beyond levels required for viscosity reduction, since excessive oxidation results in increased chain cleavage. A typical convenient range of oxidation ring-opens from 3 to 50 percent of the α-D-glucopyranose rings.

To minimize grain size dispersity, particularly in preparing high bromide tabular grain emulsions, it is contemplated to employ in combination with the hydrophilic colloid peptizer, particularly gelatino-peptizer or any of the varied forms of starch peptizers described above, a polyalkylene oxide block copolymer surfactant. Preferred polyalkylene oxide block copolymer surfactants for reducing the COV of the high bromide {111} tabular grain emulsions are selected from among S-I, S-II, S-III and S-IV categories.

The category S-I surfactants contain at least two terminal lipophilic alkylene oxide block units linked by a hydrophilic alkylene oxide block unit and can be, in a simple form, schematically represented as indicated by diagram I below:

| | | | |
|---|---|---|---|
| (S-I) | LAO1 | HAO1 | LAO1 |

where

LAO1 in each occurrence represents a terminal lipophilic alkylene oxide block unit and HAO1 represents a hydrophilic alkylene oxide block linking unit.

It is generally preferred that HAO1 be chosen so that the hydrophilic block linking unit constitutes from 4 to 96 percent of the block copolymer on a total weight basis.

It is, of course, recognized that the block diagram I above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula S-Ia:

$$HO-(\overset{CH_3}{\overset{|}{C}}HCH_2O)_x-(CH_2CH_2O)_y-(CH_2\overset{CH_3}{\overset{|}{C}}HO)_{x'}-H \qquad \text{(S-Ia)}$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of at least 760 (preferably at least 1,000) to less than about 16,000 (preferably less than about 10,000) are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram SII below:

| | | |
|---|---|---|
| HAO2 | LAO2 | HAO2 |

where

HAO2 in each occurrence represents a terminal hydrophilic alkylene oxide block unit and LAO2 represents a lipophilic alkylene oxide block linking unit. It is generally preferred that LAO2 be chosen so that the lipophilic block unit constitutes from 4 to 96 percent of the block copolymer on a total weight basis.

It is, of course, recognized that the block diagram S-II above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form in oligomeric or polymeric block repeating unit that serves as the lipophilic block linking unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula S-IIa:

$$HO-(CH_2CH_2O)_y-(\overset{CH_3}{\overset{|}{C}}HCH_2O)_x-(CH_2CH_2O)_y-H \qquad \text{(S-IIa)}$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of at least 1,000 up to less than about 30,000 (preferably less than about 20,000) are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula S-IIIa below:

$$(H—HAO3)_z—LOL—(HAO3—H)_{z'} \qquad \text{(S-IIIa)}$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed in the practice of the invention can take the form shown in formula S-IIIb:

$$(H—HAO3—LAO3)_z—L—(LAO3—HAO3—H)_{z'} \qquad \text{(S-IIIb)}$$

where

HAO3 in each occurrence represents a terminal hydrophilic alkylene oxide block unit, LAO3 in each occurrence represents a lipophilic alkylene oxide block unit, L represents a linking group, such as amine or diamine, z is2and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed in the practice of the invention can take the form shown in formula S-IIIc:

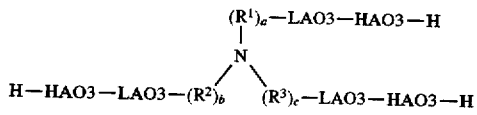

(S-IIIc)

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula S-IIIc.

When z+z' equal four, the linking group must be tetravalent. Diamines are preferred tetravalent linking groups. When a diamine is used to form the linking unit L, the polyalkylene oxide block copolymer surfactants employed in the practice of the invention can take the form shown in formula S-IIId:

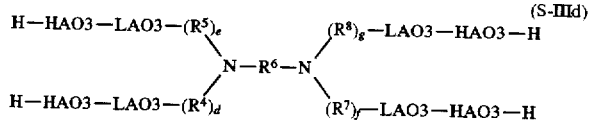

(S-IIId)

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed in the practice of this invention contain at least three terminal lipophilic alkylene oxide block units linked through a hydrophilic alkylene oxide block linking unit and can be, in a simple form, schematically represented as indicated by formula S-IVa below:

$$(H—LAO4)_z—HOL—(LAO4—H)_{z'} \qquad \text{(S-IVa)}$$

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed in the practice of the invention can take the form shown in formula S-IVb:

$$(H—LAO4—HAO4)_z—L'—(HAO4—LAO4—H)_{z'} \qquad \text{(S-IVb)}$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed in the practice of the invention can take the form shown in formula S-IVc:

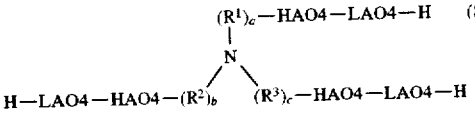

(S-IVc)

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1.

To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula S-IVc.

When z+z' equal four, the linking group must be tetravalent. Diamines are preferred tetravalent linking groups. When a diamine is used to form the linking unit L', the polyalkylene oxide block copolymer surfactants employed in the practice of the invention can take the form shown in formula S-IVd:

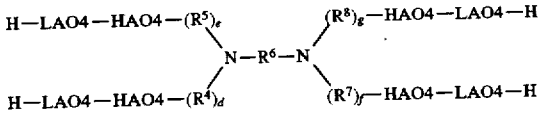

(S-IVd)

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1.

It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H—HAO3—LAO3— or H—LAO4—HAO4— group satisfies formula VIII or IX, respectively:

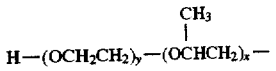

(VIII)

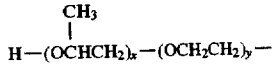

(IX)

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula X

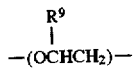

(X)

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XI:

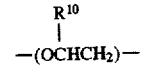

(XI)

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Although the polyalkylene oxide block copolymer surfactants identified above are specifically preferred, any basically similar polyalkylene oxide block copolymer surfactants that have been employed to prepare high bromide {111} tabular grain silver halide emulsions can be employed, such as those of Tsaur et al U.S. Pat. Nos.

5,147,771, 5,147,772, 5,147,773, 5,171,659, 5,210,013 and 5,252,453 and Kim et al U.S. Pat. Nos. 5,236,817 and 5,272,048, incorporated by reference.

To be effective to reduce tabular grain dispersity only very low levels of surfactant are required in the emulsion at the time parallel twin planes are being introduced. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 7 times the interim weight of silver. However, surfactant concentrations of up to 10 times the interim weight of silver are contemplated. During grain growth increased levels of surfactant can be employed without interfering with tabular grain growth.

The hydrophilic colloid peptizer can be introduced during emulsion preparation in any conventional manner. It is generally recognized that no hydrophilic colloid need be present at grain nucleation. As taught by Mignot U.S. Pat. 4,334,012, here incorporated by reference, by using ultrafiltration to remove soluble salts that contribute to grain agglomeration, it is possible to progress beyond grain growth into the early stages of grain growth with no peptizer.

Typically, hydrophilic colloid at the conclusion of grain precipitation is present in the dispersing medium an amount from 5 to 50 grams, preferably 10 to 30 grams, per mole of silver halide. It is generally preferred that the hydrophilic colloid peptizer be present in the dispersing medium prior to grain nucleation. The hydrophilic colloid peptizer typically forms from 0.2 to 10 (preferably 6) percent by weight of the contents of the reaction vessel.

It is generally preferred to have present in the dispersing medium prior to initiating grain precipitation at least 10 percent, preferably from 20 to 80 percent, of the total hydrophilic peptizer present in the emulsion at the conclusion of grain preparation.

Conventionally grain precipitation is initiated by adding to the dispersing medium within the reaction vessel a small amount of a bromide or chloride salt, such as alkali, alkaline earth or ammonium halide salt, contemplated to be later introduced during precipitation. This assures a stoichiometric excess of halide ion with respect to silver ion at the initiation of precipitation.

Subsequently a soluble silver salt, such as silver nitrate, is introduced through a first jet. A soluble iodide salt, such as an alkali, alkaline earth or ammonium iodide salt, is introduced through a second jet. Chloride and/or bromide ions can be introduced through the second jet with the iodide or introduced through one or more separate jets. If sufficient chloride and/or bromide salt is initially placed in the reaction vessel, it is possible to dispense with further chloride and/or bromide addition. In most instances chloride and/or bromide ions are introduced into the reaction vessel concurrently with the introduction of silver ion.

The presence of iodide in the reaction vessel is limited in relation of the chloride and/or bromide present in the reaction vessel so that silver iodohalide grains are precipitated exhibiting a face centered cubic rock salt crystal lattice structure. This is achieved by limiting iodide addition to less than the saturation level of iodide ion in the silver chloride and/or bromide crystal lattice being formed by precipitation.

While iodide ion constitutes only a minor component of the silver iodohalide grains, its concentration and distribution can significantly influence photographic performance. While iodide concentrations can range up to saturation levels in the face centered cubic rock salt crystal lattice structure, for most photographic applications iodide levels are limited to low iodide levels, typically ranging from about 0.5 to 10 (preferably 1.0 to 6.0) mole percent, based on silver.

Both uniform and non-uniform iodide distributions are common, as illustrated by *Research Disclosure*, Item 38957, cited above, I. Emulsion grains and their preparation, A. Grain halide composition, paragraph (4). Typically low surface iodide concentrations are desired, although Chaffee et al U.S. Pat. No. 5,358,840 illustrates advantageous photographic properties with a maximum iodide concentration at the surface of the grains.

The silver iodohalide grains produced by the process of the invention can take any conventional shape. Illustrations of varied forms of silver iodohalide grains are provided by *Research Disclosure*, Item 38957, cited above, I. Emulsion grains and their preparation, B. Grain morphology.

In a preferred application the process of the invention is employed to prepare iodide containing high bromide tabular grain emulsions. Illustrations of conventional processes of preparing iodide containing high bromide tabular grain emulsions are provided by the following, the disclosures of which are here incorporated by reference:

Wilgus et al U.S. Pat. No. 4,434,226;
Kofron et al U.S. Pat. No. 4,439,520;
Daubendiek et al U.S. Pat. No. 4,414,310;
Black et al U.S. Pat. No. 5,334,495;
Solberg et al U.S. Pat. No. 4,433,048;
Yamada et al U.S. Pat. No. 4,647,528;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Chaffee et al U.S. Pat. No. 5,358,840; and
Delton U.S. Pat. No. 5,372,927.

The process of the present invention can be practiced by modifying conventional silver iodohalide emulsion precipitations of the type described above by substituting iodine ($I_2$) addition for all or any portion of the soluble iodide salt conventionally introduced in aqueous solution during grain precipitation, including halide conversion.

Iodine ($I_2$) is preferably introduced dissolved in a water miscible solvent, such methyl alcohol or dimethylformamide. When iodine is introduced in the presence of starch peptizer or an aldehyde, such as glucose, the following reaction occurs:

$$I_2+RCHO+HOH \rightarrow 2I^-+RC(O)OH+2H^+ \quad (XII)$$

where

R is the organic residue of the starch or aldehyde.

Although the reaction goes to completion, efficiently converting the iodine ($I_2$) introduced to iodide ion ($I^-$), the reaction is not instantaneous. As demonstrated in Example 3, below, only a third (34%) of the iodine ($I_2$) is converted to iodide ions within 30 seconds of addition, greater than 70% of the iodine is converted to iodide ions within 3 minutes. The constant removal of the iodide ion from the dispersing medium by incorporation in the grains drives the reaction. In conventional silver iodohalide grain precipitations, grains that happen to impinge upon the point of iodide ion introduction encounter higher iodide ion concentrations than the remainder of the grains, resulting in grain-to-grain variances in iodide levels and, often, variations in the structural form and photographic performance of the grains. Delaying iodide ion release during iodine ($I_2$) introduction, thereby allowing distribution of iodine ($I_2$) within the dispersing medium, local grain-to-grain and unintended intragrain variances in iodide content are entirely avoided.

It has been observed that gelatino-peptizers produce similar results when substituted for starch peptizers, but the complexity of the chemical components of gelatino-peptizers render speculative any assignment of a predominant reactive mode. It is, of course, possible to substitute other mild reducing agents for the aldehyde in formula XII.

From formula XII it is apparent that the conversion of iodine ($I_2$) to iodide ion ($I^-$) results in the formation of hydrogen ion ($H^+$) as a by-product. Unless counteracted, this can result in a undesirable lowering of the pH of the dispersing medium and slowing of the rate of release of the iodide ion. It is therefore contemplated to follow the conventional practice of monitoring the pH of the dispersing medium and adding base, as required to maintain the dispersing medium within a selected pH range, noted above between 5 to 8 and, preferably <7.0 in the practice of this invention. Any conventional base used to adjust the pH of a dispersing medium during grain precipitation can be employed. Preferred bases include alkali hydroxides (e.g., lithium, sodium or potassium hydroxide) and alkaline earth hydroxides (e.g., magnesium or calcium hydroxide). Ammonium hydroxide is a preferred base when the pH of the dispersing medium is maintained <7.0, but ammonium hydroxide acts as a strong ripening agent at basic pH levels (>7.0) and is not a preferred base when the dispersing medium is maintained on the basic side neutrality.

By incorporating a conventional buffering agent within the dispersing medium, the necessity of adding base to maintain the pH of the dispersing medium with the 5 to 8 range can be eliminated. Any buffering agent that stabilizes pH in this range and is compatible with the reactants can be employed. Partial alkali metal salts of weak mineral and organic acids form ideal buffering agents for the dispersing medium. Examples of useful buffering agents in the pH range of from 5 to 8 are disclosed in Long, *Biochemists' Handbook*, Van Nostrand Reinhold Co., N.Y., 1961, pp. 22–42, the disclosure of which is here incorporated by reference.

Techniques for monitoring both halide to silver ion stoichiometry and pH within the dispersing medium are well known. Such techniques are summarized in *Research Disclosure*, Item 38957, cited above, I. Emulsion grains and their preparation, D. Grain modifying conditions and adjustments, paragraph (1). Keller, *Science and Technology of Photography*, VCH, New York, 1993, FIG. 27, p. 59, shows a typical schematic diagram of a double-jet precipitation apparatus, including electrodes for monitoring silver ion ($Ag^+$) and pH.

Although the invention has been described in terms of substituting iodine ($I_2$) for a water soluble iodide salt in preparing a silver iodohalide emulsion, it is appreciated that the iodine can be alternatively substituted for an organic iodide compound (R-I) employed in combination with a base or nucleophilic reagent in processes of the type disclosed by Takada et al U.S. Pat. No. 5,389,508, Suga et al U.S. Pat. No. 5,418,124, Maruyama et al U.S. Pat. No. 5,525,460 and Kikuchi et al U.S. Pat. No. 5,527,664, cited above and here incorporated by reference.

Instead of introducing iodide into the grains as they are being formed, it is recognized that iodide can be used to form silver iodohalide grains by halide conversion. During halide conversion the iodine ($I_2$) is reacted to release iodide ion ($I^-$) in a dispersing medium containing silver halide grains having a face centered cubic rock salt crystal lattice structure while withholding the addition of silver. Thus, the process of the invention can be readily adapted to any conventional halide conversion process. Conventional techniques for halide conversion are illustrated by *Research Disclosure*, Item 38957, cited above, I. Emulsion grains and their preparation, A. Grain halide composition, paragraph (8). Halide conversion using iodine according to the teachings of this invention is specifically preferred to be practiced on tabular grains that exhibit low surface iodide concentrations.

It is contemplated to undertake the partial halide conversion of low surface iodide high bromide tabular grain emulsions by the use of iodine as a source of iodide ion as described above. In a specifically preferred application, this invention is directed to a process of preparing a high bromide tabular grain emulsion comprised of tabular grains containing within a portion thereof iodide ions introduced by displacement of halide ions comprising (1) providing a monodisperse high bromide host tabular grain emulsion accounting for from 60 to 90 percent of total silver present at the completion of step (4), the grains present in the host tabular grain emulsion exhibiting a surface iodide concentration of less than 2 mole percent, based on silver within 0.02 μm of the surface of the grains, (2) introducing $I_2$ into the host tabular grain emulsion while withholding addition of silver ion, (3) reducing the $I_2$ to iodide ion, the iodine ion amounting to from 0.5 to 10 mole percent, based on silver present in the host emulsion, and (4) thereafter continuing growth of the host tabular grains modified by iodide ion incorporation until silver added in this step accounts for from 10 to 40 of total silver.

Monodisperse low surface iodide high bromide host tabular grain emulsions can be selected from among the conventional high bromide tabular grain emulsions disclosed in the patents cited and incorporated by reference above. As taught by Kofron et al, cited above, iodide free high bromide tabular grain emulsions (e.g., silver bromide tabular grain emulsions) can be prepared merely by withholding iodide from the preparation of silver iodohalide high bromide tabular grain emulsions.

The host tabular grain emulsions contain at least 50 mole percent, preferably at least 70 mole percent and optimally at least 90 mole percent bromide, based on total silver. It is specifically contemplated to employ emulsions as starting materials that consist essentially of silver bromide. Minor amounts of other halides can be present. Silver bromide and silver chloride are compatible in all ratios in the face centered cubic crystal lattice structure that forms the grains. Thus, silver chloride can be present in the high bromide tabular grains and in the central regions of the tabular grains of the invention in concentrations of up to 50 mole percent, based on silver.

While any conventional iodide concentration can be present centrally within the grains of the host tabular grain emulsion, the surface iodide concentration is limited to less than 2 mole percent, based on silver within 0.02 μm of a grain surface. In the patents cited above to show conventional high bromide tabular grain emulsions, any of the high bromide tabular grain emulsions exhibiting iodide concentrations at or near the grain surfaces of 2 mole percent or more can be converted to low surface iodide tabular grain emulsions merely by shelling the tabular grains with a high bromide silver halide containing less than 2 mole percent iodide, based on silver forming the shell. It is recognized that it is generally most convenient to employ host tabular grain emulsions that exhibit low (<2 mole percent) iodide concentrations throughout the grains, including those that are entirely free of iodide.

The low surface iodide high bromide host tabular grains can have an average aspect ratio lower than that of the tabular grains in the emulsions produced by the process of the invention. The starting emulsion can have any convenient conventional average aspect ratio, such its any average aspect ratio reported in the patents cited above. Preferably the average aspect ratio of the host tabular grains is at least 5.

The average thickness of the low surface iodide high bromide host tabular grains can take any value compatible with achieving the desired final average aspect ratio of tabular grains produced. It is generally preferred that the thickness of the host tabular grains be less than 0.3 μm. Thin host tabular grains, those having an average thickness of less than 0.2 μm, are preferred. It is specifically contemplated to employ as starting materials ultrathin tabular grain emulsions—i.e., those having an average tabular grain thickness of <0.07 μm. Low surface iodide high bromide ultrathin tabular grain emulsions are included among the emulsion disclosures of the patents cited above to show conventional high bromide tabular grain emulsions and are additionally illustrated by the following, the disclosures of which are here incorporated by reference:

Zola and Bryant EPO 0 362 699;

Antoniades et al U.S. Pat. No. 5,250,403; and

Sutton et al U.S. Pat. No. 5,334,469.

Both the starting host tabular grain emulsions and the process product partially halide converted tabular grain emulsions produced are preferably monodisperse. That is, the emulsions exhibit a coefficient of variation (COV) of grain ECD of less than 30 percent. Generally the advantages of monodispersity are enhanced as COV is decreased below 30 percent. Low surface iodide high bromide host tabular grain emulsions can be selected from among those known to the art exhibiting COV values of less than 15 percent and, in emulsions where particular care has been exercised to limit dispersity, less in 10 percent. Low COV high bromide tabular grain emulsions are included among the emulsion disclosures of the patents cited above to show conventional high bromide tabular grain emulsions and are additionally illustrated by the following, the disclosures of which are here incorporated by reference:

Saito et al U.S. Pat. No. 4,797,354;

Tsaur et al U.S. Pat. No. 5,210,013;

Kim et al U.S. Pat. No. 5,272,048; and

Sutton et al U.S. Pat. No. 5,334,469.

Low COV host tabular grains can be shelled according to the invention without increasing their dispersity.

The low surface iodide high bromide host tabular grain emulsions have tabular grain projected areas sufficient to allow the tabular grains in the final emulsion to account for at least 50 percent of total grain projected area. The preferred starting materials are those that contain tabular grain projected areas of at least 70 percent and optimally at least 90 percent. Generally, the exclusion of nontabular grains to the extent conveniently attainable is preferred.

Partial halide conversion of the host tabular grain emulsion can commence under any convenient conventional emulsion precipitation condition within the 5 to 8 pH range. For example, iodide introduction can commence immediately upon completing precipitation of the host tabular grain emulsion. When the host tabular grain emulsion has been previously prepared and is later introduced into the reaction vessel, conditions within the reaction vessel are adjusted within conventional tabular grain emulsion preparation parameters to those present at the conclusion of host tabular grain emulsion precipitation, taught by the host tabular grain emulsion citations above. For host tabular grain emulsions in which the tabular grains have {111} major faces the teachings of Kofron et al, cited above and here incorporated by reference, are generally applicable and preferred.

Partial halide conversion is achieved by reacting iodine ($I_2$) in redox reaction as described above to release iodide ion ($I^-$) while withholding the addition of silver ion. The minimum amount of iodide ion released is chosen to achieve significant halide conversion. Preferably this amounts to at least 0.5 (most preferably 1.0) mole percent iodide ion, based on the silver contained in the host tabular grain emulsion. Maximum iodide ion incorporation is 10 mole percent, based on the silver contained in the host tabular grain emulsion. Limiting the amount of iodide ion released during the halide conversion step limits halide conversion and thereby contributes to maintaining the tabular grains intact.

Following the partial halide conversion step additional silver halide is precipitated, accounting for from 10 to 40 percent of the total silver forming the grains of the completed emulsion. The halide composition of the silver halide precipitation following halide conversion can take any conventional form so long as the completed grains retain a high bromide content. The silver halide precipitated following halide conversion is preferably selected from among the silver halide compositions used to form the host tabular grains. In one form it is specifically preferred to introduce only silver and bromide salts in forming the final 10 to 40 percent of the grains. Alternatively, it is contemplated to introduce additional iodide, but preferably the iodide is limited to less than 2 mole percent, based on the silver being concurrently precipitated.

Any convenient conventional technique for precipitating the last 10 to 40 percent of the total silver to complete formation of the high bromide tabular grains can be employed. For example, any conventional grain shelling technique can be employed. Typically grain shelling is accomplished by concurrently introducing silver and halide salts through separate jets. Alternatively, a silver halide Lippmann emulsion can be introduced to achieve shelling of the grains.

Instead of shelling the tabular grains; with the final 10 to 40 percent of precipitated silver it is contemplated to conduct precipitation under conditions conducive to continued tabular grain growth—that is, under conditions that favor silver halide deposition along the peripheral edges of the tabular grains. Such techniques are illustrated by the patents cited above to show host tabular grain preparations.

In another specific preferred technique for precipitating the final 10 to 40 percent of silver forming the tabular grains, further precipitation can be achieved by introducing a soluble silver salt, such as silver nitrate, without adding halide. Since high bromide silver halide emulsions are conventionally precipitated and maintained in a stoichiometric excess of bromide ion to avoid fogging the grains, the addition of silver ions without concurrent halide addition results in a reaction between the silver ions and the stoichiometric excess bromide ions. These bromide ions can in part be those supplied by the bromide ion introduction during the partial halide conversion step. This technique for completing precipitation of the tabular grains is described in more detail in Fenton et al U.S. Pat. No. 5,476,760, here incorporated by reference, which demonstrates increased photographic sensitivity for the tabular grain emulsions so prepared.

The completed tabular grain emulsions preferably exhibit a mean ECD of less than 10 μm, preferably less than 5.0 μm. For most applications the tabular grains have a mean ECD of less than 3.0 μm. The tabular grains preferably exhibit an average aspect ratio of greater than 5 and, most preferably, greater than 8. Where the final 10 to 40 percent of silver is deposited under conditions that favor tabular grain growth, the mean thickness of the completed tabular grains can satisfy the thickness ranges set out above for the host tabular grains. In all instances (e.g., even when shelling is undertaken) the mean thickness of the completed tabular grains is preferably less than 0.3 μm.

Apart from the features that have been specifically discussed, the high bromide tabular grain emulsions can contain conventional features of the type disclosed in the patents cited above to illustrate high bromide host tabular grain emulsions. These conventional features include conventional selections of dopants, peptizers, vehicles and hardeners. Once prepared the emulsions can be chemically sensitized, spectrally sensitized, combined with antifoggants and stabilizers, image dye providing components, and other conventional photographic addenda. Such conventional features are illustrated by *Research Disclosure*, Vol. 389, September 1996, Item 38957.

EXAMPLES

The invention can be better appreciated by reference to the following specific embodiments. In each of the host tabular grain emulsions tabular grains accounted for substantially all (>97%) of total grain projected area. The molar concentrations of iodine are reported on the basis of the molar weight being the atomic weight of iodine (I)—that is, 126.9.

Starch Peptized High Bromide Tabular Grain Emulsions Using Elemental Iodine as the Source of Iodide

Host Emulsion

Starch Made AgBr Tabular Grain Emulsion MS-1

A starch solution was prepared by heating at 90° C. for 45 min a stirred 8,000 g aqueous mixture containing 54 mmole NaBr and 160 g of an oxidized cationic waxy corn starch. (The starch derivative, STA-LOK® 140 is 100% amylopectin that had been treated to contain (quaternary ammonium groups and oxidized with 2 wgt % chlorine bleach. It contains 0.31 wgt % nitrogen and 0.00 wgt % phosphorous. It was obtained from A. E. Staley Manufacturing Co., Decatur, Ill.)

The resulting solution was cooled to 40° C., readjusted to 8,000 g with distilled water, and then 0.294 mole of sodium acetate and 28 mg of Pluronic®-L43 were added. (Pluronic®-L43 was obtained from BASF Corp. and has the following formula:

$$HO(CH_2—CH_2O)6(CH_2—CH(CH_3)O)_{22}—(CH_2—CH_2O)_6H.)$$

To a vigorously stirred reaction vessel of the starch solution at 40° C., pH 5.0, were added 4M $AgNO_3$ solution and 4M NaBr solution, each at a constant rate of 200 mL per min. After 0.2 min, the addition of the solutions was stopped, 57 mL of 2M NaBr were added rapidly, and the temperature of the contents of the reaction vessel was increased to 60° C. at a rate of 5° C. per 3 min; then 40 mmoles of ammonium sulfate solution were added and the pH of the contents was adjusted to 10.6 in 2 minutes using 2.5M NaOH solution. After 9 additional minutes at pH 10.6, the contents were adjusted to a pH of 6.0 using 4M $HNO_3$ and maintained at this value throughout the remainder of the precipitation. A 1M $AgNO_3$ solution was added at 10 mL per min for 3 min at a constant pBr of 1.68 and 1M NaBr was added at a rate needed to maintain the desired pBr. The pBr was adjusted to 1.91 and the $AgNO_3$ solution addition rate was accelerated to a flow rate of 74 mL per min in 71 min and then held at this flow rate. After 4 L of the 1M $AgNO_3$ solution had been added, the pBr was adjusted to 2.06 and maintained at this value for the rest of the precipitation. After a total of 6 L of the 1M $AgNO_3$ solution had been added the addition was stopped and 20% of the kettle contents were removed and discarded. Then the addition of the 1M $AgNO_3$ solution was resumed and 4M NaBr solution was now used to maintain the pBr of 2.06. A total of 11 L of 1M $AgNO_3$ solution was used. The emulsion was cooled to 40° C. and finally washed by diafiltration to a pBr of 3.34. The pH was adjusted to 5.6.

The resulting AgBr tabular grain emulsion consisted of tabular grains with an average equivalent circular diameter of 1.93 μm, an average thickness of 0.098 μm, and an average aspect ratio of 20. The tabular grain population made up 99.9% of the total projected area of the emulsion grains.

Example 1

Slow Elemental Iodine Addition

To a vigorously stirred reaction vessel containing 0.20 mole Emulsion MS-1, 15.8 mmole glucose, 26 mmole NaBr and distilled water to 413 g at 55° C. and pH at 6.5 was added at 1.0 mL per min to a well-mixed region of the vessel, 10 mL of a methanolic solution containing 7.9 mmole of iodine. The mixture was stirred an additional 10 min. The pH was maintained at 6.5±0.2 by adding initially 0.5M and later 0.1M NaOH solutions. (The amount of NaOH solution added at various times was noted.) Then a 1M $AgNO_3$ solution was added at 1 mL per min. (The amount of $AgNO_3$ solution required to restore the silver ion potential to the value prior to the iodine addition was noted.) When the pBr reached 2.42 a 1M NaBr solution was concurrently added to maintain this pBr. A total of 0.066 mole of silver was added. The resulting emulsion was cooled to 30° C. and then poured into 2 L of distilled water and allowed to gravity settle at 4° C. for 4 days. The clear supernatant was discarded and the solid phase was resuspended in a 1% starch solution to yield 142 g of emulsion having a pBr of 3.10 and pH of 5.7.

The resulting AgIBr tabular grain emulsion consisted of tabular grains with an average equivalent circular diameter of 1.85 μm, an average thickness of 0.13 μm, and an average aspect ratio of 14. The tabular grain population made up 99% of the total projected area of the emulsion grains.

The approximate extent of iodide formation was calculated in two different ways; (1) from the amount of $AgNO_3$ solution required after the iodine addition to restore the silver ion potential back to its starting value, and (2) the amount of base required to maintain a constant pH. Both values should equal 7.9 mmoles and are considered to be within experimental error of theoretical. The actual iodide content was determined by neutron activation analysis. (A portion of the emulsion was diluted 7-fold with distilled water, centrifuged, and the solid phase analyzed for the percent iodide.) The results ire summarized in Table II.

Analysis of the emulsion grains by transmission electron microscopy revealed that the tabular grains exhibited a distinct structural feature at corners and edges of the grains. Typically the feature contained many dislocation lines, with each feature containing at least 3 dislocation lines. A statistical analysis showed that 99% of the tabular grains had at least one outer perimeter region with this distinct structural feature. The results are given in Table II.

Composition analysis of selective regions of these tabular grains, using a focused beam of electrons (diameter of about 800 Å), showed that these outer perimeter regions (those containing dislocations) contained more iodide, based on silver, than the central regions. The corner regions with dislocations were the most common structural feature and contained the most iodide. The center region contained an average of 1 mole % iodide, the edge region contained an average of 1.5 mole % iodide and the corner region contained an average of 3.5 mole % iodide.

Example 2 (control)

Slow KI Addition

This emulsion was precipitated similarly to that of Example 1, except that 10 mL of an aqueous solution containing 7.9 mmole of KI was used instead of the methanolic iodine solution.

The resulting AgIBr tabular grain emulsion consisted of tabular grains with an average equivalent circular diameter of 1.92 μm, an average thickness of 0.13 μm, and an average aspect ratio of 15. The tabular grain population made up 99% of the total projected area of the emulsion grains. The results are summarized in Tables II and III.

Example 3

Rapid Elemental Iodine Addition

To a vigorously stirred reaction vessel containing 0.20 mole Emulsion MS-1, 15.8 mmole glucose, 9.2 mmole NaBr and distilled water to 408 g at 55° C. and pH at 6.0 was added in 2 sec to a well-mixed region of the vessel, 2 mL of a dimethylformamide solution containing 7.9 mmole of iodine. The pH was maintained at 6.0+0.2 by initially adding 0.5M and later 0.1M NaOH solution. (The amount of NaOH solution added at various times was noted.) After 20 min, a 1M $AgNO_3$ solution was added at 1 mL per min. (The amount of $AgNO_3$ solution required to restore the silver ion potential to the value prior to the iodine addition was noted.) When the pBr reached 2.42 a 1M NaBr solution was concurrently added to maintain this pBr. A total of 0.066 mole of silver was added. The resulting emulsion was cooled to 30° C. and then poured into 2 L of distilled water and allowed to gravity settle at 4° C. for 4 days. The clear supernatant was discarded and the solid phase was resuspended in a 1% starch solution to yield 165 g of emulsion having a pBr of 3.10 and pH of 5.7.

The resulting AgIBr tabular grain emulsion consisted of tabular grains with an average equivalent circular diameter of 1.91 μm, an average thickness of 0.13 μm, and an average aspect ratio of 15. The tabular grain population made up 99% of the total projected area of the emulsion grains.

The results are summarized in Tables II and III. The theoretical amount of NaOH needed to maintain a pH of 6.0, based on the iodine added, is 7.9 mmoles. At 15 and 30 seconds after iodine addition, 1.8 and 2.8 mmoles, respectively, of NaOH had been added to maintain the pH at 6.0. At a minute after iodine addition, 4.6 mmoles of NaOH had been added. After 3 minutes 6.5 mmoles of NaOH add been added. By the end of the precipitation a total of 8.3 mmoles of base were used. This demonstrates a gradual conversion of iodine to iodide ion, well within the capability of mixing to protect against excessively high local concentrations of iodide ion.

Composition analysis of the emulsion grains by electron microscopy revealed that they contained an average of 1 mole .1 iodide in the central region, 2.25 mole % iodide in the edge region, and 4 mole % iodide in the comer region.

Example 4 (control)

Rapid KI Addition

This emulsion was precipitated similarly to that of Example 3, except that 2 mL of an aqueous solution containing 7.9 mmole of KI was used instead of the DMF solution of iodine.

The resulting AgIBr tabular grain emulsion consisted of tabular grains with an average equivalent circular diameter of 1.96 μm, an average thickness of 0.13 μm, and an average aspect ratio of 15. The tabular grain population made up 99% of the total projected area of the emulsion grains. The results are summarized in Tables II and III.

Example 5

Rapid Elemental Iodine Addition, No Added Reducing Agent, and Buffered to Control pH.

To a vigorously stirred reaction vessel containing 0.20 mole Emulsion MS-1, 9.2 mmole NaBr, 20 mmole $NaH_2PO_4$ and distilled water to 407 g at 55° C., pH adjusted to 7.0, was added in 2 sec to a well-mixed region of the vessel, 2 mL of a dimethylformamide solution containing 7.9 mmole of iodine. (The pH dropped to 6.30 at 6 sec, 6.10 at 1 min, 6.06 at 20 min after the iodine addition. Note that the release of 7.9 mmole of acid would be expected to drop the pH of this buffer to 6.08.) After 20 min, a 1M $AgNO_3$ solution was added at 1 mL per min. (The amount of $AgNO_3$ solution required to restore the silver ion potential to the value prior to the iodine addition was noted.) When the pBr reached 2.42 a 1M NaBr solution was concurrently added to maintain this pBr. A total of 0.066 mole of silver was added. The final pH was 5.94 corresponding to 8.47 mmoles acid released. The resulting emulsion was cooled to 30° C. and then poured into 2 L of distilled water and allowed to gravity settle at 4° C. for 4 days. The clear supernatant was discarded and the solid phase was resuspended in a 1% starch solution to yield 165 g of emulsion having a pBr of 3.10 and pH of 5.7.

The resulting AgIBr tabular grain emulsion consisted of tabular grains with an average equivalent circular diameter of 1.90 μm, an average thickness of 0.13 μm, and an average aspect ratio of 15. The tabular grain population made up 99% of the total projected area of the emulsion grains.

The results are summarized in Tables II and III.

Demonstration of Role of Silver Halide In Converting Iodine to Iodide Ion

To demonstrate that the iodine would not be significantly reduced in the absence of the emulsion, the following experiments were performed.

Experiment 1

To a vigorously stirred reaction vessel containing 9.2 mmole NaBr, 20 mmole $NaH_2PO_4$ and distilled water to 407 g at 55° C., pH adjusted to 7.0, was added in 2 sec to a well-mixed region of the vessel, 2 mL of a dimethylformamide solution containing 7.9 mmole of iodine. The mixture was stirred for 20 min at 55° C., at which time the pH, pAg, and solution color were noted. From the pH change, the extent of reaction was calculated to be only 30% and from silver ion electrode readings, the extent of reaction was calculated to be only 18%. (The reaction had stopped when the pI had reached 2.46.) The color of the solution was orange indicating free iodine was still present.

Experiment 2

The above demonstration was repeated but 4.0 g of STA-LOK® 140 starch was additionally added to the reaction vessel. From the pH change, the extent of reaction was calculated to be only 30% and from the silver ion electrode readings, the extent of reaction was calculated to be only 12%. (The reaction had stopped when the pI had reached 2.64.) The color of the solution was dark red indicating an amylopectin starch-iodine complex was still present.

TABLE II

Summary of Iodine to Iodide Reaction.

| Example (Control) | $Ag^+$ used to restore pBr to starting value (mmole) | Total NaOH used to maintain pH (mmole) | % of total NaOH used during first 3 min after iodine addition. | Iodide content in AgIBr by neutron activation analysis (mole %) |
|---|---|---|---|---|
| 1 | 9.4 | 9.87 | 75 | 3.0 |
| (2) | 10.8 | 0.03 | — | 3.1 |
| 3 | 6.9 | 8.27 | 79 | 2.5 |
| (4) | 8.4 | 0.06 | — | 3.0 |
| 5 | 8.0 | 8.47* | 93* | 2.7 |

*Calculated from pH change of buffer system.

TABLE III

Summary of Electron Microscopy Results

| Example (Control) | Total CAI (No. %) | CAI with face dislocations (No. %) | PIG (No. %) | Remaining grains (No. %) | Total Grains Counted |
|---|---|---|---|---|---|
| 1 | 99.0 | 2.3 | 1.0 | 0.0 | 307 |
| (2) | 96.7 | 3.8 | 3.3 | 0.0 | 211 |

TABLE III-continued

Summary of Electron Microscopy Results

| Example (Control) | Total CAI (No. %) | CAI with face dislocations (No. %) | PIG (No. %) | Remaining grains (No. %) | Total Grains Counted |
|---|---|---|---|---|---|
| 3 | 99.6 | 24.5 | 0.4 | 0.0 | 282 |
| (4) | 26.4 | 4.9 | 1.9 | 71.7 | 205 |
| 5 | 98.9 | 13.1 | 0.3 | 0.8 | 367 |

Total CAI = (111) AgBrI T-grain containing ≧3 dislocation lines, primarily in outer perimeter regions (mostly in corner regions).
CAI with face dislocation = (111) AgBrI T-grain containing ≧3 dislocation lines in outer perimeter regions and have ≧10 dislocation lines visible over the (111) tabular face region.
PIG = Partially intact grains, i.e., (111) AgBrI grains with observable portions of the grain missing, due to reaction with soluble iodide.

The results shown in Table III demonstrate that the Example 1 emulsion had a significantly higher percentage of total CAI grains than did Control Example 2, and that Examples 3 and 5 emulsions had a significantly higher percentage of total CAI grains than did Control Example 4.

Example 6

Photographic Performance

The emulsions of Examples 1 and 3 and Control Examples 2 and 4 were chemically sulfur and gold sensitized and spectrally sensitized to the green region of the spectrum as described below.

At 40° C., with stirring, sodium acetate solution was added (28 mmole per Ag mole) and the pH of the emulsion was adjusted to 5.6. Then sequentially the following solutions of these salts were added so that the emulsion contained (mmole/Ag mole); 1.48 of NaSCN, 1.14 of anhydro-5-chloro-9-ethyl-5'-phenyl-3'-(3-sulfobutyl)-3-(3-sulfopropyl)oxacarbocyanine hydroxide triethylammonium salt, 0.25 of anhydro-3,9-diethyl-5-phenyl-3'-methylsulfonylcarbamoylmethyloxathiacarbocyanine hydroxide, 0.0025 of sodium aurous(I) dithiosulfate, 0.0018 of sodium thiosulfate, and 0.12 of 3-[3-[(methylsulfonyl) amino]-3-oxopropyl]benzothiazolium tetrafluoroborate. The mixture was heated to 60° C. at a rate of 1.67° C. per min, and held at this temperature for 10 min.

The resulting sensitized emulsions were mixed with gelatin, a coupler dispersion, antifoggant, surfactants and hardener and coated onto a clear photographic film support at 0.81 g/m² silver, 1.08 g/m² of a magenta dye-forming coupler, 0.013 g/m² of 4-hydroxy-6-methyl-1,3,3a,7-tetraazaindene, sodium salt, and 4.09 g/m² of gelatin.

Evaluation

The sensitized coatings were exposed to light of wavelength longer than 460 nm (Kodak Wratten™ WR 9 filter) and through a 0 to 4.0 log density graduated step-tablet, and processed in a Kodak Flexicolor™ C-41 color negative process using a development time of 3 min 15 sec. The results are summarized in Table IV.

TABLE IV

Photographic Results

| Coating | Dmax | Dmin | Speed (at 0.2 above Dmin) | Gamma | Speed (at 1.0 above Dmin) | Gamma |
|---|---|---|---|---|---|---|
| 1 | 3.49 | 0.37 | 117 | 1.00 | 115 | 3.29 |
| Control 2 | 3.35 | 0.25 | 112 | 0.96 | 110 | 3.29 |
| 3 | 3.50 | 0.22 | 112 | 0.84 | 112 | 3.28 |
| Control 4 | 3.50 | 0.17 | 100 | 1.16 | 100 | 3.34 |

The speeds were measured at a density of 0.2 and at 1.0 above minimum density and is repoited in relative linear speed units.

Table IV demonstrates that Coating 1 (made from sensitized Example 1 emulsion) had higher speed than Control Coating 2 (made from sensitized Control Example 2 emulsion) and that Coating 3 (made from sensitized Example 3 emulsion) had higher speed than Control Coating 4 (made from sensitized Control Example 4 emulsion).

Gel Made High Bromide Tabular Grain Emulsions Using Elemental Iodine as the Source of Iodide Host Emulsion SM-1

AgBr Tabular Grain Emulsion

This AgBr tabular grain emulsion was prepared using published procedures such as those described in Tsaur et. al, U.S. Pat. No. 5,147,771. The emulsion contained of tabular grains with an average equivalent circular diameter of 3.05 μm, an average thickness of 0.097 μm, and an average aspect ratio of 31. The tabular grain population made up 96% of the total projected area of the emulsion grains.

Example 7

Slow Elemental Iodine Addition

To a vigorously stirred reaction vessel containing 0.20 mole Emulsion SM-1, 15.8 mmole glucose, 26 mmole NaBr and distilled water to 413 g at 55° C. and pH at 6.5 was added at 1.0 mL per min to a well-mixed region of the vessel, 10 mL of a methanolic solution containing 7.9 mmole of iodine. The mixture was stirred an additional 10 min. The pH was maintained at 6.5±0.2 by adding initially 0.5M and later 0.1M NaOH solutions. (The amount of NaOH solution added at various times was noted.) Then a 1M $AgNO_3$ solution was added at 1 mL per min. (The amount of $AgNO_3$ solution required to restore the silver ion potential to the value prior to the iodine addition was noted.) When the pBr reached 2.42 a 1M NaBr solution was concurrently added to maintain this pBr. A total of 0.066 mole of silver was added. The resulting emulsion was cooled to 40° C., 100 mL of a 2.7% phthalated gelatin solution was added and the mixture poured into 4 L of distilled water and washed using the techniques taught in Yutzy and Russel U.S. Pat. No. 2,614,929. The resulting emulsion was adjusted to pH 5.6 and had a pBr of 3.28.

This AgIBr tabular grain emulsion consisted of tabular grains with an average equivalent circular diameter of 3.03 μm, an average thickness of 0.13 μm, and an average aspect ratio of 23. The tabular grain population made up 96 % of the total projected area of the emulsion grains.

The approximate extent of iodide formation was calculated in two different ways; (1) from the amount of $AgNO_3$ solution required after the iodine addition to restore the silver ion potential back to its starting value, and (2) the amount of base required to maintain a constant pH. The results are summarized in Table V. Both values should equal 7.9 mmoles.

Analysis of the emulsion grains by transmission electron microscopy revealed that most of the tabular grains exhibited a distinct structural feature containing ≧3 dislocation lines in the outer perimeter regions (mostly in comer regions). The results are given in Table VI.

Example 8

Slow Elemental Iodine Addition

This emulsion was precipitated similarly to that of Example 7, except that ~7 mL of the methanolic solution containing 5.1 mmole of iodine was used. The final emulsion was adjusted to pH 5.6 and had a pBr of 3.23.

This AgIBr tabular grain emulsion consisted of tabular grains with an average equivalent circular diameter of 2.98 μm, an average thickness of 0.13 μm, and an average aspect ratio of 23. The tabular grain population made up 96 % of the total projected area of the emulsion grains.

The approximate extent of iodide formation was calculated in two different ways; (1) from the amount of $AgNO_3$ solution required after the iodine addition to restore the silver ion potential back to its starting value, and (2) the amount of base required to maintain a constant pH. The results are summarized in Table V. Both values should equal 5.1 mmoles.

Analysis of the emulsion grains by transmission electron microscopy revealed that the tabular grains exhibited a distinct structural feature at comers and edges of the grains. Typically the feature contained many dislocation lines, with each feature containing at least 3 dislocation lines. A statistical analysis showed that 100% of the tabular grains had at least one outer perimeter region with this distinct structural feature. The results are given in Table VI.

Composition analysis of selective regions of these tabular grains, using a focused beam of electrons (diameter of about 800Å), showed that these outer perimeter regions (those containing dislocations) contained more iodide, based on silver, than the central regions. The comer regions with dislocations were the most common structural feature and contained the most iodide. The center region contained an average of 1 mole % iodide, the edge region contained an average of 1 mole % iodide and the corner region contained an average of 2 mole % iodide.

Example 9 (control)

Slow KI Addition

This emulsion was precipitated similarly to that of Example 7, except that 10 mL of an aqueous solution containing, 7.9 mmole of KI was used instead of the methanolic iodine solution.

The resulting AgIBr tabular grain emulsion consisted of tabular grains with an average equivalent circular diameter of 2.95μm, an average thickness of 0.13μm, and an average aspect ratio of 23. The tabular grain population made up 96% of the total projected area of the emulsion grains. The results are summarized in Tables V and VI.

Example 10

Rapid Elemental Iodine Addition

To a vigorously stirred reaction vessel containing 0.20 mole Emulsion SM-1, 15.8 mmole glucose, 9.2 mmole NaBr and distilled water to 408 g at 55° C. and pH at 6.0 was added in 2 sec to a well-mixed region of the vessel, 2 mL of a dimethylformamide solution containing 7.9 mmole of iodine. The pH was maintained at 6.0±0.2 by initially adding 0.5M and later 0.1M NaOH solution. (The amount of NaOH solution added at various times was noted.) After 20 min, a 1M $AgNO_3$ solution was added at 1 mL per min. (The amount of $AgNO_3$ solution required to restore the silver ion potential to the value prior to the iodine addition was noted.) When the pBr reached 2.42 a 1M NaBr solution was concurrently added to maintain this pBr. A total of 0.066 mole of silver was added. The resulting emulsion was cooled to 40° C., 100 mL of a 2.7% phthalated gelatin solution was added and the mixture poured into 4 L of distilled water and washed by flocculation. The final emulsion was adjusted to pH 5.6 and had a pBr of 3.21.

The resulting AgIBr tabular grain emulsion consisted of tabular grains with an average equivalent circular diameter of 3.04 μm, an average thickness of 0.13 μm, and an average aspect ratio of 23. The tabular grain population made up 96% of the total projected area of the emulsion grains. The results are summarized in Tables V and VI.

Example 11

Rapid Elemental Iodine Addition, No Added Reducing Agent, and Buffered to Control pH.

To a vigorously stirred reaction vessel containing 0.20 mole Emulsion SM-1, 9.2 mmole NaBr, 20 mmole $NaH_2PO_4$, and distilled water to 407 g at 55° C., pH adjusted to 7.0, was added in 2 sec to a well-mixed region of the vessel, 2 mL of a dimethylformamide solution containing 7.9 mmole of iodine. (The pH dropped to 6.45 at 4 sec, 6.22 at 1 min, 6.19 at 3 min, and 6.18 at 20 min after the iodine addition.) After 20 min, a 1M $AgNO_3$ solution was added at 1 mL per min. (The amount of $AgNO_3$ solution required to restore the silver ion potential to the value prior to the iodine addition was noted.) When the pBr reached 2.42 a 1M NaBr solution was concurrently added to maintain this pBr. A total of 0.066 mole of silver was added. The final pH was 6.06 corresponding to 8.00 mmoles acid released. The resulting emulsion was cooled to 40° C., 100 mL of a 2.7% phthalated gelatin solution was added and the mixture poured into 4 L of distilled water and washed by flocculation. The final emulsion was adjusted to pH 5.6 and had a pBr of 2.94.

The resulting AgIBr tabular grain emulsion consisted of tabular grains with an average equivalent circular diameter of 2.96 μm, an average thickness of 0.13 μm, and an average aspect ratio of 23. The tabular grain population made up 96% of the total projected area of the emulsion grains. The results are summarized in Tables V and VI.

Demonstration of Role of Silver Halide In Converting Iodine to Iodide Ion

To demonstrate that the iodine would not be significantly reduced in the absence of the emulsion, the following experiments were performed.

Experiment 3

To a vigorously stirred reaction vessel containing 9.2 mmole NaBr, 20 mmole $NaH_2PO_4$, and distilled water to 407 g at 55° C., pH adjusted to 7.0, was added in 2 sec to a well-mixed region of the vessel, 2 mL of a dimethylformamide solution containing 7.9 mmole of iodine. The mixture was stirred for 20 min at 55° C., at which time the pH, vAg, and solution color were noted. From the pH change, the extent of reaction was calculated to be only 30% and from the silver ion electrode readings, the extent of reaction was calculated to be only 18%. (The reaction had stopped when the pI had reached 2.46.) The color of the solution was orange indicating free iodine was still present.

Experiment 4

The above demonstration was repeated but 8.0 g of gelatin was additionally added to the reaction vessel. From the pH change, the extent of reaction was calculated to be only 38% and from the silver ion electrode readings, the extent of reaction was calculated to be only 16%. (The reaction had stopped when the pI had reached 2.49.) The color of the solution was orange indicating free iodine was still present.

TABLE V

Summary of Iodine to Iodide Reaction.

| Example (Control) | $Ag^+$ used to restore pBr to starting value (mmole) | Total NaOH used to maintain pH (mmole) | % of total NaOH used during first 3 min after iodine addition. | Iodide content in AgIBr by neutron activation analysis (mole %) |
|---|---|---|---|---|
| 7 | 9.5 | 8.10 | 91 | 2.8 |
| 8 | 6.5 | 6.76 | 94 | 1.8 |
| (9) | 10.1 | 0.09 | — | 3.2 |
| 10 | 6.5 | 7.07 | 85 | 2.6 |
| 11 | 8.0 | 8.00* | 88* | 2.6 |

*Calculated from pH change of buffer system.

TABLE VI

Summary of Electron Microscopy Results

| Example (Control) | Iodide Source and Time for Addition (S = 10 min) (R = 2 sec) | | Total CAI (No. %) | CAI With Face Dislocations (No. %) | PIG (No. %) | Remaining Grains (No. %) | Total Grains Counted |
|---|---|---|---|---|---|---|---|
| 7 | $I_2°$ | S | 100.0 | 77.1 | 0.0 | 0.0 | 214 |
| 8 | $I_2°$ | S | 100.0 | 72.6 | 0.0 | 0.0 | 168 |
| (9) | KI | S | 95.4 | 0.6 | 4.6 | 0.0 | 174 |
| 10 | $I_2°$ | R | 97.0 | 30.3 | 3.0 | 0.0 | 165 |
| 11 | $I_2°$ | R | 99.0 | 44.4 | 1.0 | 0.0 | 286 |

Total CAI = (111) AgBrI T-grain containing ≧3 dislocation lines, primarily in outer perimeter regions (mostly in corner regions).
CAI with face dislocation = (111) AgBrI T-grain containing ≧3 dislocation lines in outer perimeter regions and have ≧10 dislocation lines visible over the (111) tabular face region.
PIG = Partially intact grains. (111) AgBrI grains with observable portions of the grain missing, due to reaction with soluble iodide.

The results shown in Table VI demonstrate that the Example 7 and 8 emulsions, made using iodine, added slowly, as an iodide release agent, had a significantly higher percentage of total CAI grains than did Control Example 9, made using potassium iodide, added slowly. Example 11 emulsion, made using iodine added rapidly (2 sec) and using a pH buffer, had a significantly higher percentage of total CAI grains than did Example 10 made similarly but without a buffer.

The invention has been described in detail with particular reference to preferred embodiments thereof, but it will be understood that variations and modifications can be effected within the spirit and scope of the invention.

What is claimed is:

1. A process of preparing a high bromide tabular grain emulsion comprised of tabular grains containing within a portion thereof iodide ions introduced by displacement of halide ions comprising (1) providing a monodisperse silver bromide host tabular grain emulsion comprised of a dispersing medium and silver bromide grains accounting for from 60 to 90 percent of total silver present at the completion of step (4), (2) introducing $I_2$ into the host tabular grain emulsion while withholding addition of silver ion, (3) reducing the $I_2$ to iodide ion, the iodine ion amounting to from 0.5 to 10 mole percent, based on silver present in the host emulsion, and (4) thereafter continuing growth of the host tabular grains modified by iodide ion incorporation until silver added in this step accounts for from 10 to 40 of total silver.

2. A process according to claim 1 wherein the dispersing medium contains a gelatino-peptizer.

3. A process according to claim 1 wherein the dispersing medium contains a cationic starch.

4. A process according to claim 1 wherein the dispersing medium contains an aldehyde.

5. A process according to claim 1 wherein the dispersing medium contains a buffering agent for the pH of the dispersing medium within the range of from 5 to 8.

6. A process according to claim 1 wherein the dispersing medium is maintained at a pH of less than 7.0.

7. A process according to claim 1 wherein the iodide ion derived from the $I_2$ accounts for at least 1.0 mole percent of the silver present in the host emulsion.

8. A process according to claim 1 wherein the step of reducing $I_2$ to iodide ion is performed by maintaining the emulsion within a pH range of from 5 to 8 to release $I^-$ for incorporation into the silver bromide host tabular grains.

* * * * *